US012582204B2

(12) United States Patent
Brodine et al.

(10) Patent No.: US 12,582,204 B2
(45) Date of Patent: Mar. 24, 2026

(54) BAND ASSEMBLY WITH REMOVABLE BAND RETAINER

(71) Applicant: Apple Inc., Cupertino, CA (US)

(72) Inventors: Nicholas S. Brodine, Los Gatos, CA (US); Molly J. Anderson, San Francisco, CA (US); Clement C. Tissandier, San Francisco, CA (US); Osamu Yabe, Mountain View, CA (US); Mengxi Zhao, Anlu (CN); Timothy S. Lui, San Francisco, CA (US); Chia Tse Yeh, New Taipei (TW); Kai-Yu Chung, Redwood City, CA (US); Jen-Chun Hsu, Taipei (TW); Tatsuya Sano, San Jose, CA (US); Peng Li, Shenzhen (CN)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 18/235,782

(22) Filed: Aug. 18, 2023

(65) Prior Publication Data

US 2024/0065390 A1 Feb. 29, 2024

Related U.S. Application Data

(63) Continuation of application No. PCT/CN2022/116136, filed on Aug. 31, 2022.

(51) Int. Cl.
*A44C 5/00* (2006.01)
*A44C 5/20* (2006.01)

(52) U.S. Cl.
CPC ..... *A44C 5/2033* (2013.01); *A44C 5/0053* (2013.01)

(58) Field of Classification Search
CPC ..... A44C 5/2033; A44C 5/0053; A44C 5/20; A44C 5/185; A44C 5/2071; A44B 11/20;
(Continued)

(56) References Cited

U.S. PATENT DOCUMENTS 223,043 A * 12/1879 Hamilton, Jr. ..... A44C 5/0092 63/11
717,844 A * 1/1903 Gutmann ..... A41F 3/045 24/265 R (Continued)

FOREIGN PATENT DOCUMENTS

CH 690800 A5 * 1/2001 ..... G04B 37/1486
CN 103156341 A * 6/2013 ..... A44C 5/02

(Continued)

OTHER PUBLICATIONS

International Search Report and Written Opinion from PCT/CN2022/116136, dated Dec. 20, 2022, 10 pages.

*Primary Examiner* — Jason W San
*Assistant Examiner* — Anna S Rashid
(74) *Attorney, Agent, or Firm* — BAKERHOSTETLER

(57) ABSTRACT

Bands for wearable devices include multiple band retainers used to maintain engagement between an assembly (e.g., a pair) of bands. Some band retainers may be permanently affixed with the band at a certain location of the band, while other band retainers can be removable. The removable band retainers can be moved to different locations of the band, thus allowing the band retainer to retain another band at different locations. As a result, the assembly of bands can be used with different users, and in particular, users with different wrist sizes. Moreover, using multiple band retainers can provide an engagement force between the bands to withstand higher-impact events, such as swimming and diving. Additionally, bands and band retainers may include one or more liquid-resistant and corrosion-resistant materials.

19 Claims, 12 Drawing Sheets

(58) Field of Classification Search
CPC .... A44B 11/24; G04B 37/1486; G04B 37/18; G04B 37/20; Y10T 24/4782; Y10T 24/47; Y10T 24/45005; Y10T 24/4501; Y10T 24/45079; Y10T 24/45009
USPC ..... 24/573.09, 574.1, 578.15; 63/3.1, 3.2
See application file for complete search history.

(56) References Cited

U.S. PATENT DOCUMENTS 805,674 A * 11/1905 Senderling ..... B64D 17/32 403/348
940,917 A * 11/1909 Asquith ..... A44B 13/0017 235/50 R
1,199,690 A * 9/1916 Gillan ..... F16B 5/06 24/581.1
1,216,322 A * 2/1917 Kales ..... A44C 5/14 224/164
1,242,152 A * 10/1917 Depollier ..... A44C 5/14 24/265 R
1,394,552 A * 10/1921 Hoeschen ..... A44B 11/24 2/322
1,543,399 A * 6/1925 Smith ..... A44C 5/2071 2/322
1,626,160 A * 4/1927 Schwalberg ..... A44C 5/16 224/178
1,725,786 A * 8/1929 Eklund ..... A44C 5/14 24/265 R
1,748,609 A * 2/1930 Lester ..... A44C 5/22 24/574.1
1,923,025 A * 8/1933 Morse ..... E05B 67/00 70/180
2,359,148 A * 9/1944 Partridge ..... A44C 5/16 24/17 AP
2,420,435 A * 5/1947 Lackow ..... A44C 5/22 24/DIG. 30
2,536,063 A * 1/1951 Kirsten ..... A44B 11/24 24/167
2,713,445 A * 7/1955 Speck ..... A44C 5/14 63/4
2,932,074 A * 4/1960 Resnick ..... G04B 37/1493 968/360
2,937,798 A * 5/1960 Morf ..... A44C 5/0092 D11/4
3,042,277 A * 7/1962 Stradella ..... F16B 45/028 24/DIG. 45
3,175,266 A * 3/1965 Mcmullen ..... A44B 11/24 24/181
3,286,316 A * 11/1966 Marosy ..... A44C 5/2061 24/574.1
3,462,807 A * 8/1969 Marquardt ..... A44C 5/2047 24/616
3,612,365 A * 10/1971 Dintsman ..... G04B 37/1493 24/265 WS
3,939,534 A * 2/1976 Hayes ..... A44C 5/14 24/265 B
D279,276 S * 6/1985 Matsuo ..... D11/4
D279,555 S * 7/1985 Matsuo ..... D11/4
4,539,736 A * 9/1985 Yokosuka ..... A44C 5/2042 24/574.1
4,573,242 A * 3/1986 Lankton ..... B65D 63/1081 24/17 AP
4,700,874 A * 10/1987 Mock ..... A44C 5/0053 63/3
D301,840 S * 6/1989 Houlihan ..... D10/38
4,858,283 A * 8/1989 Takeuchi ..... A44B 11/24 24/178
4,984,442 A * 1/1991 Benson ..... A44B 15/00 70/459
5,457,976 A * 10/1995 Stillwagon ..... A44B 15/002 70/456 R
5,459,909 A * 10/1995 Nussberger ..... A44C 5/2061 24/DIG. 57
5,530,999 A * 7/1996 Barnes ..... F16B 21/165 24/635
5,685,185 A * 11/1997 MacDonald ..... A47G 29/10 70/459
5,689,867 A * 11/1997 Katz ..... A44C 15/001 63/1.17
6,081,973 A * 7/2000 Liu ..... A44B 11/24 24/178
6,108,821 A * 8/2000 Malsoute ..... A44B 11/008 2/338
6,260,245 B1 * 7/2001 Marsetti ..... B65G 21/2072 24/658
6,381,814 B1 * 5/2002 Colpo ..... A44C 5/2052 63/3.1
6,449,812 B1 * 9/2002 Calce ..... G04B 37/1486 224/164
6,668,608 B1 * 12/2003 Derman ..... A44B 15/002 70/456 R
6,722,544 B1 * 4/2004 Stephens ..... A45F 3/04 2/265
7,966,704 B2 * 6/2011 Yurman ..... A44C 5/2028 63/21
8,613,544 B2 * 12/2013 Kitahara ..... B29C 70/70 368/282
8,763,869 B2 * 7/2014 Gerard-Goddet .... A44C 5/0053 224/164
9,776,851 B2 * 10/2017 Chen ..... B68C 1/14
9,943,142 B1 * 4/2018 Thomsen ..... A44B 17/0076
9,974,287 B2 * 5/2018 Nelson ..... A01K 65/00
10,178,895 B1 * 1/2019 Huang ..... A44B 15/007
D862,460 S * 10/2019 Zhang ..... D14/344
10,433,621 B1 * 10/2019 Thomsen ..... A44C 5/2076
10,729,210 B1 * 8/2020 Sano ..... A44C 5/18
D904,920 S * 12/2020 Harms ..... D14/344
10,945,494 B1 * 3/2021 Thomsen ..... A44C 5/2076
D928,647 S * 8/2021 Harms ..... D24/186
D929,884 S * 9/2021 Yi ..... D11/3
11,612,220 B2 * 3/2023 Moritz ..... A44B 11/22 24/68 E
D1,004,460 S * 11/2023 Anderson ..... D11/3
D1,008,259 S * 12/2023 Anderson ..... D14/344
D1,028,758 S * 5/2024 Akana ..... D14/344
D1,039,393 S * 8/2024 Ma ..... D10/132
D1,046,675 S * 10/2024 Chen ..... D11/3
D1,049,906 S * 11/2024 Chen ..... D11/3
2006/0077337 A1 * 4/2006 Sakai ..... G02C 1/02 351/41
2008/0092344 A1 * 4/2008 Bell ..... A44C 5/20 24/265 B
2008/0250612 A1 * 10/2008 Yamamoto ..... A44C 5/2052 24/265 WS
2009/0271957 A1 * 11/2009 Lovato ..... A44B 11/266 24/194
2009/0300892 A1 * 12/2009 Yurman ..... A44C 5/2028 24/573.11
2012/0174458 A1 * 7/2012 Burnsed, Jr. ..... F41C 33/002 24/684
2013/0219960 A1 * 8/2013 Gerard-Goddet .... A44C 5/0053 63/3.2
2014/0163515 A1 * 6/2014 Hyman ..... A61M 25/02 604/500
2015/0033518 A1 * 2/2015 Moritz ..... A44B 11/22 24/68 E
2015/0289608 A1 * 10/2015 Rivera ..... A44C 5/14 368/282
2016/0004222 A1 * 1/2016 Barnes ..... G04B 37/1493 368/281
2016/0200563 A1 * 7/2016 Chen ..... B68C 1/14 24/178
2017/0086538 A1 * 3/2017 Siahaan ..... G04B 37/1486
2017/0156454 A1 * 6/2017 Abadi ..... A44C 5/0053
2017/0285574 A1 * 10/2017 Tsushima ..... G04R 60/04
2019/0343245 A1 * 11/2019 Daga ..... A44C 25/007
2019/0380456 A1 * 12/2019 Granito ..... A44C 5/246
2020/0121032 A1 * 4/2020 Vaccari ..... A44B 11/266
2020/0367613 A1 * 11/2020 Moustafa ..... A44C 5/14
2021/0321724 A1 * 10/2021 Ting ..... A44B 11/24

(56) References Cited

U.S. PATENT DOCUMENTS

| | | | | |
|---|---|---|---|---|
| 2022/0095749 | A1* | 3/2022 | Stockinger | A44C 5/0053 |
| 2023/0042111 | A1* | 2/2023 | Li | A44C 5/2042 |
| 2025/0185763 | A1* | 6/2025 | Cao | A44C 5/14 |

FOREIGN PATENT DOCUMENTS

| | | | | | |
|---|---|---|---|---|---|
| CN | 103156341 | B | * | 2/2015 | A44C 5/02 |
| CN | 108024603 | A | * | 5/2018 | A44C 5/0053 |
| CN | 210432965 | U | * | 5/2020 | |
| CN | 108024603 | B | * | 6/2020 | A44C 5/0053 |
| CN | 210929947 | U | * | 7/2020 | |
| JP | 10000109 | A | * | 1/1998 | G04B 37/1486 |
| JP | 5125484 | B2 | | 1/2013 | |
| WO | WO 2020/259159 | | | 12/2020 | |
| WO | WO-2020259159 | A1 | * | 12/2020 | A44C 5/00 |

* cited by examiner

BAND ASSEMBLY WITH REMOVABLE BAND RETAINER

CROSS-REFERENCE TO RELATED APPLICATION

The present application is a continuation of International Patent Application no. PCT/CN2022/116136, entitled "BAND ASSEMBLY WITH REMOVABLE BAND RETAINER," filed Aug. 31, 2022, the entirety of which is incorporated herein by reference.

TECHNICAL FIELD

This application is directed to bands for wearable devices, and more particularly, to bands used with removable band retainers.

BACKGROUND

Bands are often used to secure wearable devices (e.g., smartwatches) to a wrist of a user. Some bands include a tang designed to enter an opening of another band, thus forming a loop with the wearable device.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
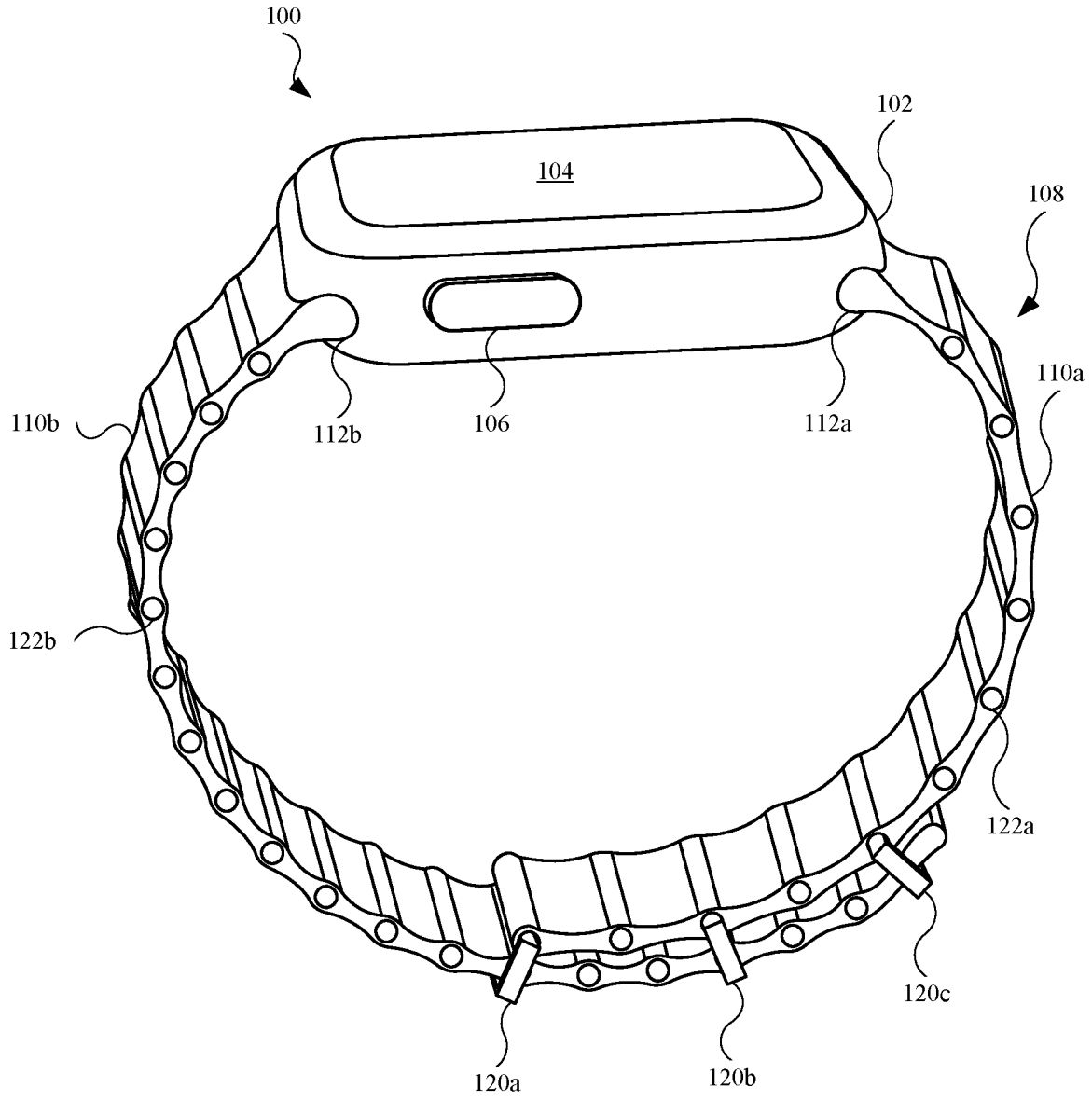
FIG. 1 illustrates a perspective view of a wearable device, in accordance with aspects of the present disclosure.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

This disclosure is related to bands used with wearable devices (e.g., smartwatches). Bands described herein may be part of an assembly of bands, each of which are secured to a device housing of an electronic device. Some features and modifications shown and described herein are directed to maintaining the bands together and preventing unwanted detachment. Additional features and modifications shown and described herein are directed to material makeup of bands to prevent breakdown of the band in certain environments.

Bands described herein may include several band retainers designed to maintain engagement between an assembly (e.g., pair) of bands. Band retainers may be secured to one of the bands in the assembly, while also having a loop with a size and shape that allows the band retainer to receive the other band in the assembly. By using multiple band retainers, the bands can withstand impact from various activities (e.g., swimming, diving) that otherwise cause the bands to disengage from each other. As a result, the wearable device is less susceptible to unwanted removal by external forces.

While some band retainers are designed to be permanently affixed to bands (e.g., through an opening of the band), other band retainers described herein can be removed from an opening of the band and subsequently positioned in another opening of the band. This feature allows the band to retain another band at different locations of the other band. Beneficially, the assembly of bands can be worn by users with different wrist sizes.

Additionally, bands may include one or more materials designed to withstand breakdown due to exposure to certain environmental conditions. For example, some bands described herein may include liquid-resistant (e.g., water-resistant) materials, such as a rubber with fluorocarbon-based fluoroelastomer materials (e.g., FKM), as a non-limiting example. Also, band retainers may include materials such as titanium, stainless steel, or a combination thereof. By using liquid-resistant materials, bands and band retainers are less susceptible to corrosion and/or breakdown when exposed to water or perspiration.

Due in part to the material makeup, some bands tend to change from their original shape. As a result, when the bands are secured with the user, the bands undergo bowing or cupping based on the relative lack of compressibility of one or more materials used to form the band. In order to address this issue, bands described herein may include a different cross-sectional thickness at different locations. For example, one region of the band associated with an end designed to secure to the wearable device may include a smaller cross-sectional thickness than another region of the band generally associated with a location in which the band engages another band in the assembly. As a result, the location of smaller cross-sectional thickness can bend more readily, resulting less bowing/cupping in a location of the band near the wearable device. Beneficially, the location of the band more visible to a user is more aesthetically pleasing and presents less unwanted resistance to bending.

These and other embodiments are discussed below with reference to FIGS. 1-19. However, those skilled in the art will readily appreciate that the detailed description given herein with respect to these Figures is for explanatory purposes only and should not be construed as limiting.

According to some embodiments, for example as shown in FIG. 1, an electronic device 100 is shown in the form of a wearable device, or smartwatch, capable of being worn by a user on an appendage (e.g., wrist) of the user. Electronic device 100 includes a device housing 102 that includes an internal chamber, or internal volume, that stores operational components, such as processors (including a central processing unit and a graphics processing unit), a memory circuit, electronic sensors (e.g., heart rate sensor, blood-oxygen level sensor), and a battery, as non-limiting examples. Device housing 102 may include a metal housing or non-metal housing.

Electronic device 100 further includes a display 104 designed to present visual information in the form of textual information, still images, or motion images (e.g., video). Display 104 may include a light-emitting diode (LED) display or an organic light-emitting diode (OLED) display, as non-limiting examples. Additionally, display 104 may include a capacitive touch input display, thus allowing display 104 to take the form of a touchscreen to receive an input from a user.

Additionally, electronic device 100 may include input mechanisms designed to provide an input to a processor of electronic device 100, with the input causing the processor to provide a command to alter and update the visual information provided by display 104. For example, electronic device 100 includes an input mechanism 106. In some embodiments, input mechanism 106 includes a button that, when depressed, actuates a switch to generate an input. Alternatively, in some embodiments, input mechanism 106 includes a dial that, when rotated, generates an input, with the input varying based upon clockwise rotation or counterclockwise rotation of input mechanism 106. Although not shown, one or more input mechanisms may be included, each of which may take a form of input mechanism 106 as described herein.

To secure to a user, a band assembly 108 designed to wrap around and secure electronic device 100 to a user. Band assembly 108 may include multiple bands. For example, as shown in FIG. 1, band assembly 108 includes a band 110*a* and a band 110*b*, with bands 110*a* and 110*b* partially overlapping each other. To secure with device housing 102, bands 110*a* and 110*b* may secure to, or within, a receptacle 112*a* and a receptacle 112*b*, respectively, of device housing 102.

To maintain engagement between bands 110*a* and 110*b*, band assembly 108 may further include multiple band retainers. As shown in FIG. 1, band assembly 108 includes a band retainer 120*a*, a band retainer 120*b*, and a band retainer 120*c*. To receive band retainers 120*a*, 120*b*, and 120*c*, band 110*a* includes several openings. For example, band 110*a* includes an opening 122*a* (representative of additional openings) that forms a void or space in band 110*a*. The openings in band 110*a* represent a location through which one of band retainers 120*a*, 120*b*, and 120*c* may be positioned. In addition to being positioned in a respective opening of band 110*a*, each of band retainers 120*a*, 120*b*, and 120*c* includes a size and shape to receive a portion of band 110*b*. While band retainers 120*a*, 120*b*, and 120*c* include a rectangular shape, other shapes, including oblong shapes with rounded/curved features, are possible.

Bands 110*a* and 110*b* may each include one or more of a variety of materials, such as silicone, woven fabric, elastic (or materials with elastically stretchable characteristics), or multiple metal links, as non-limiting examples. Additionally, bands 110*a* and 110*b* may each include one or more liquid-resistant materials. For example, in addition to the aforementioned materials, bands 110*a* and 110*b* may each include rubber, including FKM rubber. Band retainers 120*a*, 120*b*, and 120*c* may further include one or more liquid-resistant materials, such as titanium, stainless steel, or a combination thereof.

Band 110*b* may include several openings similar to those of band 110*a* to provide a generally similar design to that of band 110*a*. For example, band 110*b* includes an opening 122*b* (representative of additional openings) that forms a void or space in band 110*b*. While each of openings 122*a* and 122*b* is shown as a cylindrical opening with a circular cross section, other shapes are possible.

Figure 2:
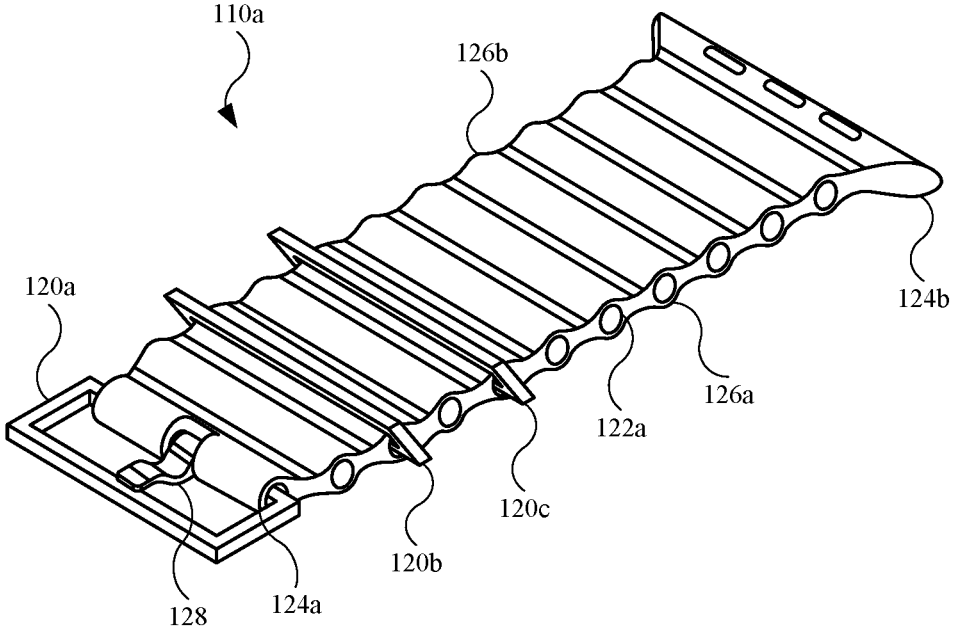
FIG. 2 illustrates a perspective view of a band for a wearable device, in accordance with aspects of the present disclosure.

Referring to FIG. 2, band 110*a* includes an end 124*a* with an opening (not labeled) through which band retainer 120*a* is located, as well as an end 124*b*, opposite of end 124*a*, designed to secure to device housing 102 (shown in FIG. 1). Opening 122*a* of band 110*a* extends from a side 126*a*, or edge, of band 110*a* to a side 126*b*, or edge, of band 110*a*, with sides 126*a* and 126*b* representing opposite sides of band 110*a*. Accordingly, opening 122*a*, representative of additional openings of band 110*a* and band 110*b* (shown in FIG. 1) may be characterized has a through hole extending laterally through band 110*a* from side 126*a* to side 126*b*.

As shown in FIG. 2, band retainer 120*a* is positioned in an opening (not labeled) located at end 124*a* of band 110*a*. Band retainer 120*a* includes a tang 128, or pin, designed to enter an opening of band 110*b*. Band retainers 120*a* and 120*b* may generally be characterized as fixed band retainers. A "fixed," "affixed," or "permanently affixed" band retainer refers to a band retainer that is designed to remain in a specific opening of a band and is generally free of separable components such that the band retainer cannot be removed from the opening of the band without being cut, broken, or otherwise damaged. For example, a continuous loop of material without manual or other user-operable release mechanisms can be affixed with respect to an opening. However, band retainer 120*c* may be characterized as a removable band retainer that is securable to band 110*a* at different locations. As a result, band retainer 120*c* may be removed from an opening of band 110*a* and subsequently positioned in another (unoccupied) opening of band 110*a*. Also, in some embodiments (not shown), band retainer 120*b* is modified to take the form of a removable band retainer similar to band retainer 120*c*.

Figure 3:
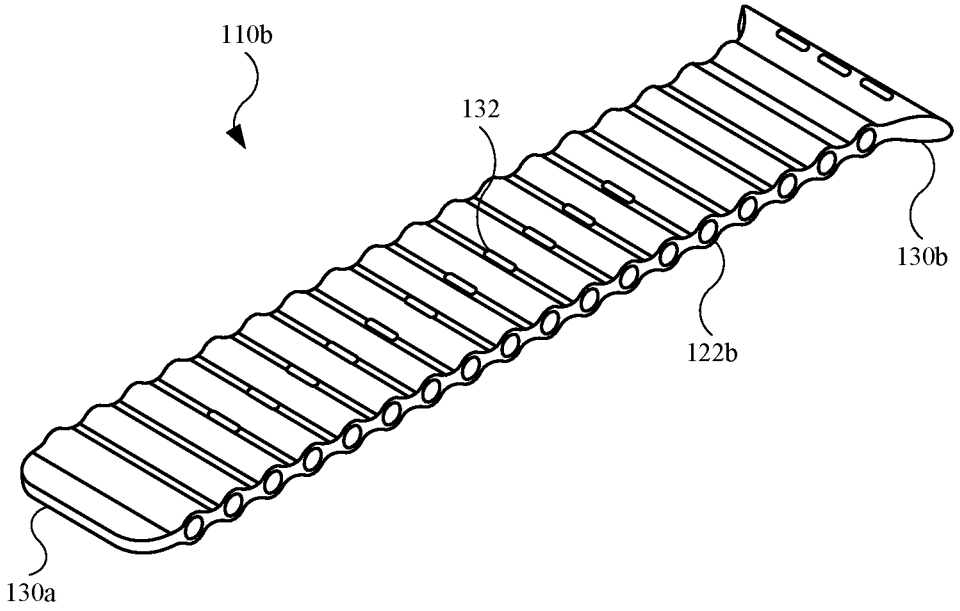
FIG. 3 illustrates a perspective view of an additional band for a wearable device, in accordance with aspects of the present disclosure.

Referring to FIG. 3, band 110*b* includes an end 130*a* designed to pass through band retainers 120*a*, 120*b*, and 120*c* (shown in FIG. 2). Band 110*b* also includes an end 130*b*, opposite of end 130*a*, designed to secure to device housing 102 (shown in FIG. 1). Opening 122*b* of band 110*b* includes features similar to those of opening 122*a* (shown in FIG. 2). In addition to side-to-side openings, band 110*b* may further include several openings. For example, band 110*b* may include an opening 132 (representative of additional openings). Opening 132 is designed to receive tang 128 (shown in FIG. 2). Moreover, any opening similar to opening 132 is designed to receive tang 128, thus allowing band 110*a* (shown in FIG. 2) and 110*b* to form a loop with different diameters.

Figure 4:
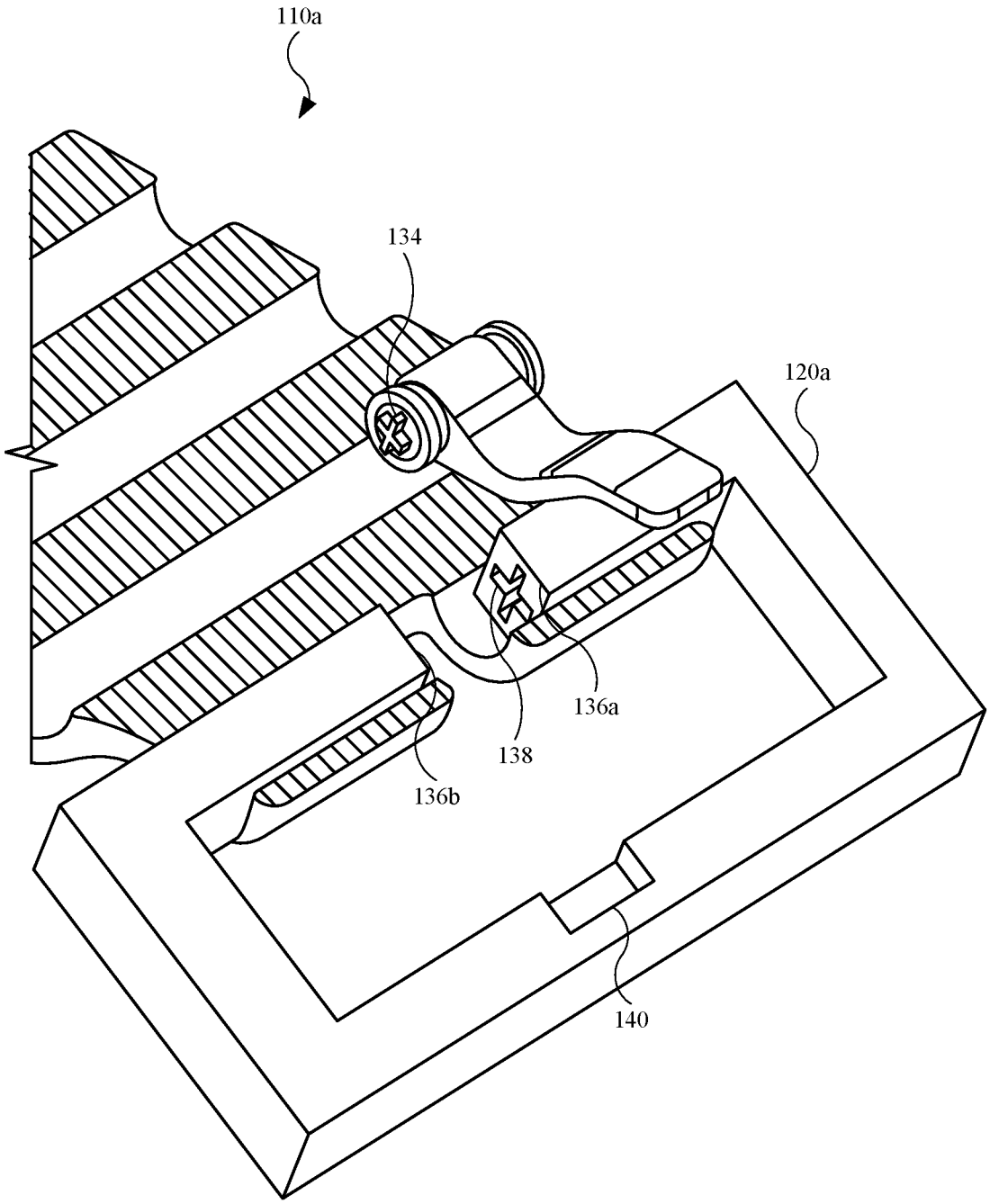
FIG. 4 illustrates a partial cross-sectional view of a band, showing features of a band retainer, in accordance with aspects of the present disclosure.

Referring to FIG. 4, tang 128 may include a retractable pin 134, or compressible pin, that allows tang 128 to secure with band retainer 120*a*. In this regard, retractable pin 134 can move relative to (e.g., in and out of) tang 128. In some embodiments, retractable pin 134 includes a pogo pin. Additionally, band retainer 120*a* includes an end 136*a* with a groove 138 designed to receive retractable pin 134. Band retainer 120*a* further includes an end 136*b* with a groove (not shown in FIG. 4) similar to that of groove 138 in terms of size and shape. As a result, retractable pin 134, having symmetrical ends, can secure with band retainer 120*a* when the ends of retractable pin 134 are positioned in a respective groove of band retainer 120*a*. Also, band retainer 120*a* includes a slot 140 designed to receive tang 128.

Figure 5:
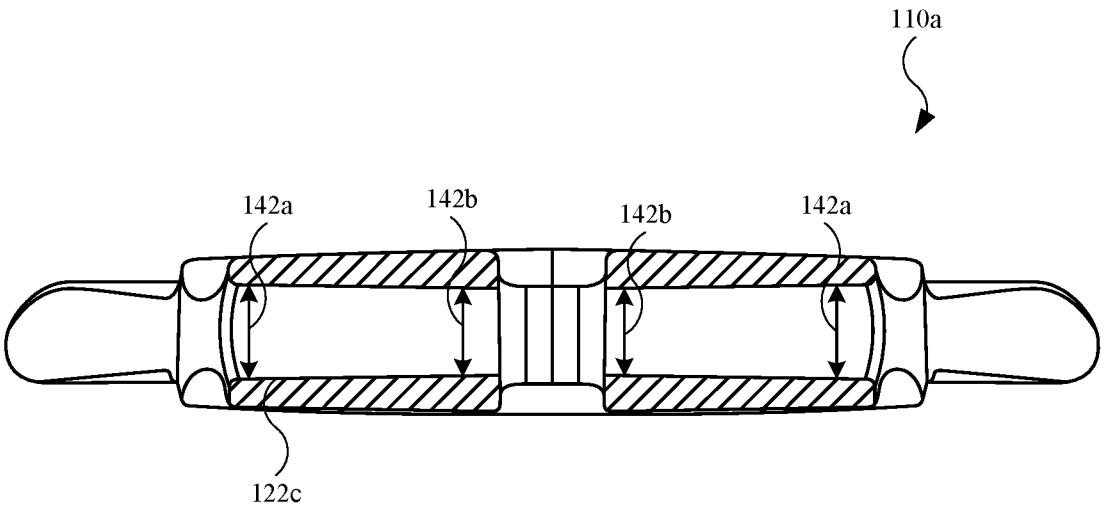
FIG. 5 illustrates a partial cross-sectional view of a band, showing features of a band opening used to receive a band retainer, in accordance with aspects of the present disclosure.

Referring to FIG. 5, an opening 122*c* of band 110*a* can be used to receive band retainer 120*a* (shown in FIG. 4). As shown, opening 122*c* includes a tapered opening. For example, a distal region of opening 122*c* includes a diameter 142*a* while a proximal region of opening 122*c* includes a diameter 142*b* that is different from diameter 142*a*. As shown in FIG. 5, diameter 142*a* is greater than diameter 142*b*, thus the diameter of opening 122*c* reduces from the distal regions to proximal regions.

Figure 6:
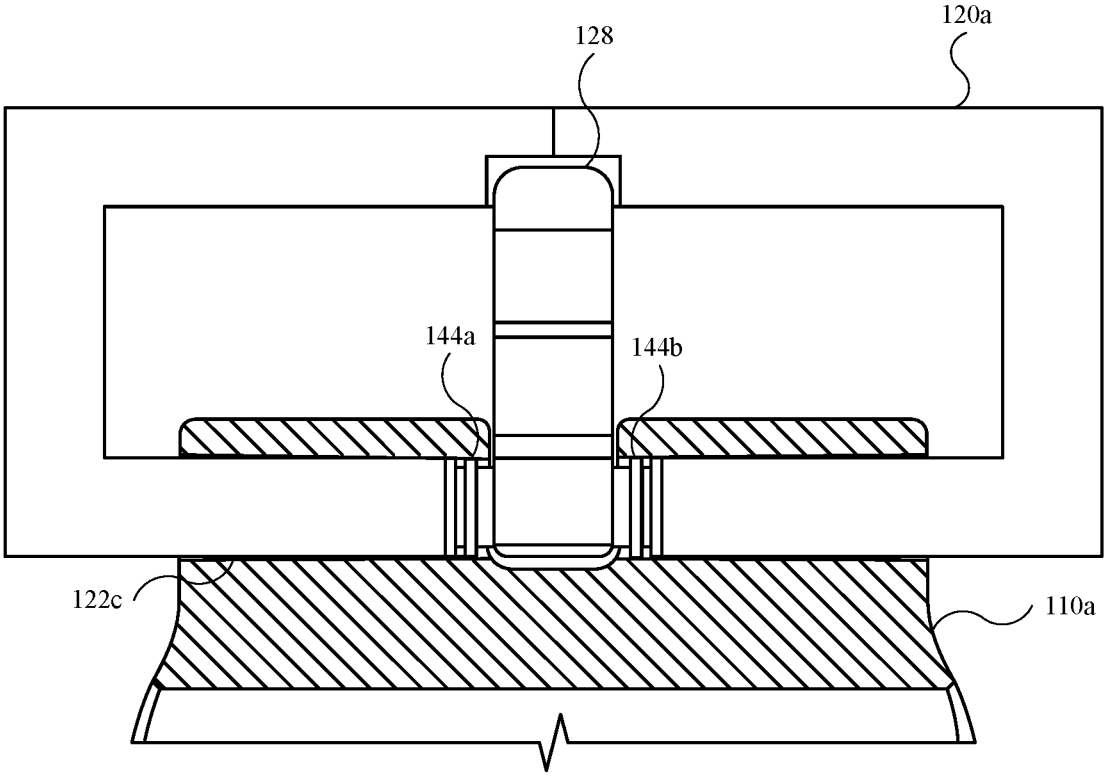
FIG. 6 illustrates a plan view of components of a band retainer engaging a band, in accordance with aspects of the present disclosure.

Referring to FIG. 6, tang 128 includes an extension 144*a* and an extension 144*b*. Extensions 144*a* and 144*b* may each take the form of a ring. When band retainer 120*a* is positioned in opening 122*c* of band 110*a*, both band retainer 120*a* and extensions 144*a* and 144*b* engage a surface of opening 122*c*. As a result of opening 122*c* having a tapered opening, extensions 144*a* and 144*b* of tang 128 are frictionally engaged with the surface of opening 122*c* in a manner similar to that of band retainer 120*a*. Put another way, the frictional force applied by the surface of opening 122*c* to extensions 144*a* and 144*b* of tang 128 is similar to the force applied to band retainer 120*a*. Beneficially, the force used to rotate band retainer 120*a* relative to opening 122*c* is similar to that used to rotate tang 128 relative to opening 122*c*.

Figure 7:
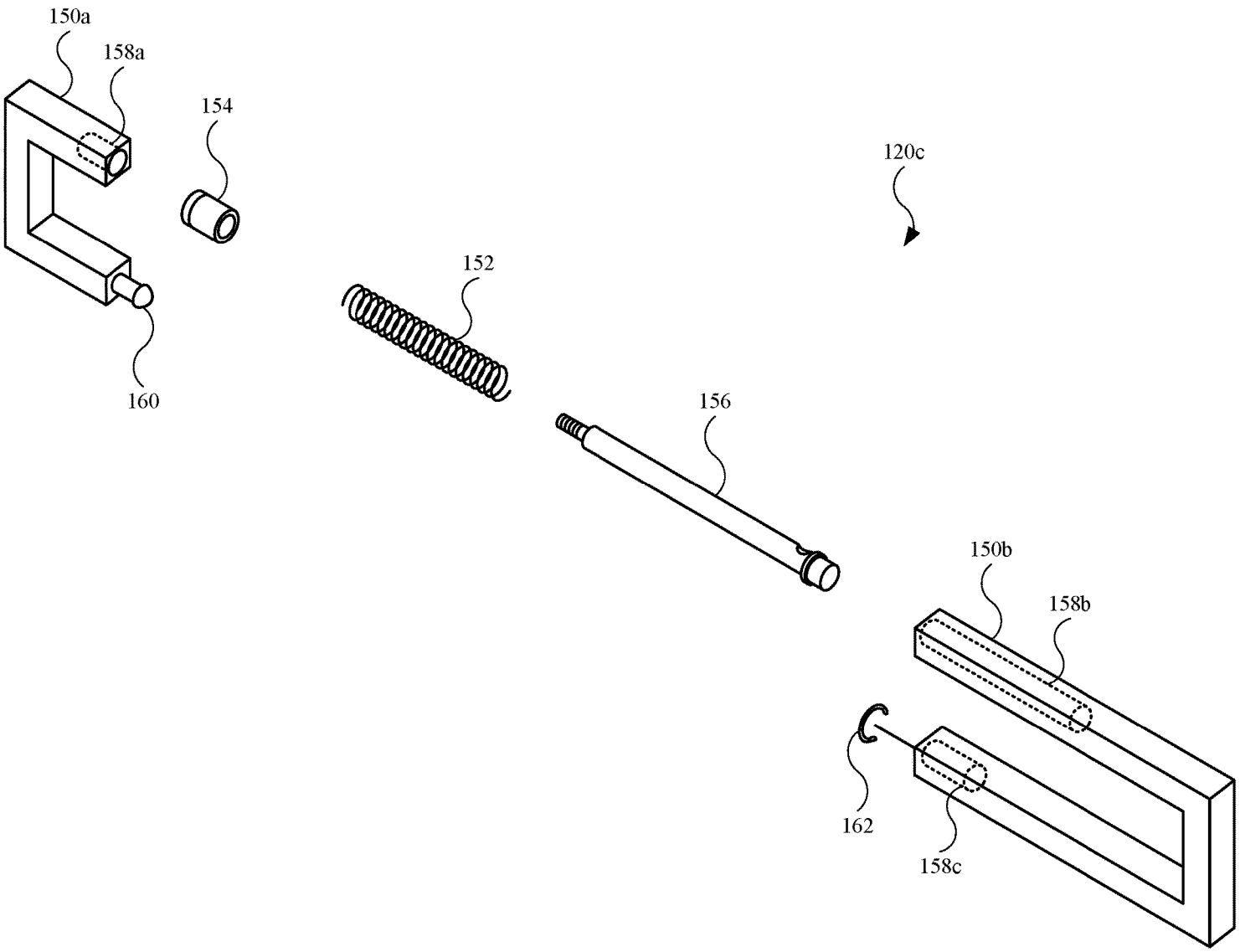
FIG. 7 illustrates an exploded view of a band retainer, in accordance with aspects of the present disclosure.

Referring to FIG. 7, several features of band retainer 120*c* are shown. For example, band retainer 120*c* includes a retainer portion 150*a* and a retainer portion 150*b* that form an external body of band retainer 120*c*. In order to maintain engagement between retainer portions 150*a* and 150*b*, band retainer 120*c* includes several components. For example, band retainer 120*c* includes a biasing component 152 that provides a force to hold retainer portions 150*a* and 150*b* together. In some embodiments, biasing component 152 is a spring. Band retainer 120*c* further includes a nut 154 used to secure biasing component 152 in retainer portion 150*b*. Additionally, band retainer 120*c* includes a pin 156 that passes through biasing component 152 and nut 154, and secures to retainer portions 150*a* and 150*b*. Pin 156 is positioned in and secured to retainer portion 150*a* at a cavity 158*a*, or hollow region, of retainer portion 150*a*, and is further positioned in and secured to retainer portion 150*b* at a cavity 158*b* of retainer portion 150*b*. Nut 154 can be secured to retainer portion 150*b* through a threaded engagement with cavity 158*b* of retainer portion 150*b*, while pin 156 can be secured to retainer portion 150*a* through a threaded engagement with cavity 158*a* of retainer portion 150*a*. To provide an additional securing force, retainer portion 150*a* may include an extension 160 that mates with a clip 162 located in a cavity 158*c* of retainer portion 150*b*. Clip 162 may include a C-clip designed to engage and receive extension 160 of retainer portion 150*a*.

Figure 8:
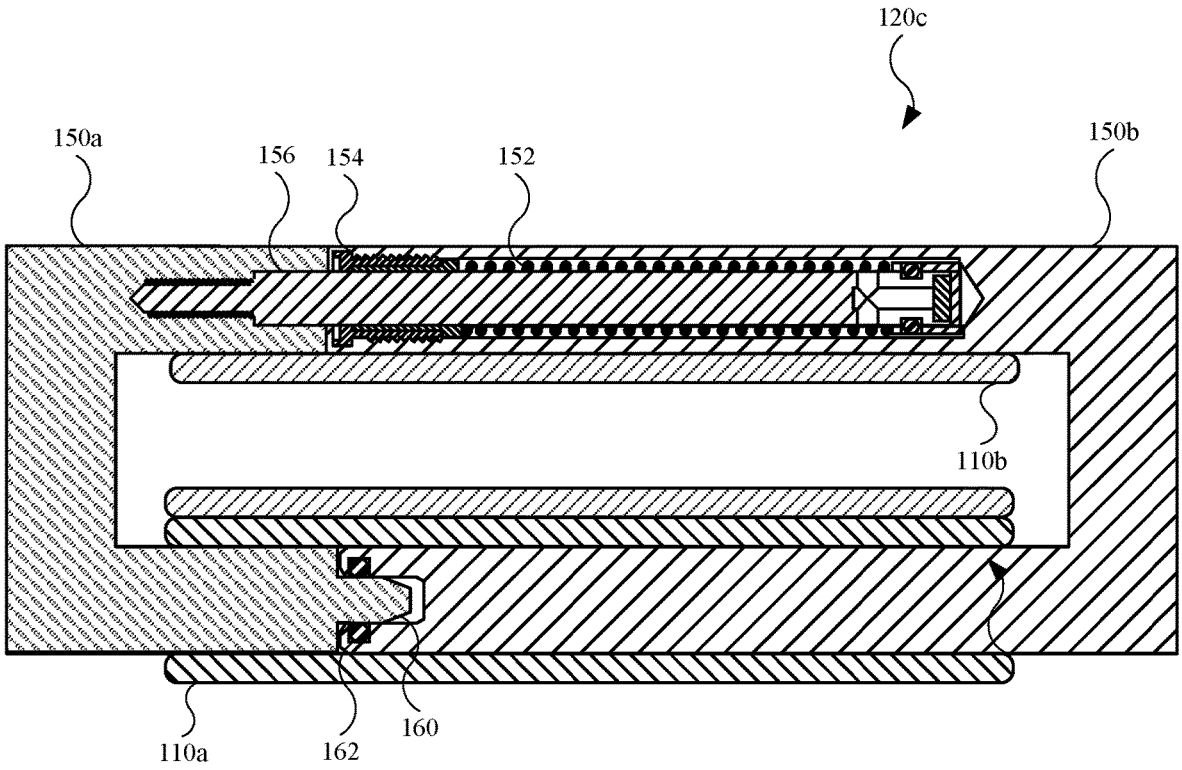
FIG. 8 illustrates a cross-sectional view of a band retainer, in accordance with aspects of the present disclosure.

Referring to FIG. 8, band retainer 120*c* is assembled and positioned in an opening 122*d* of band 110*a*. Further, band retainer 120*c* forms a loop that receives band 110*b*. Nut 154 is in threaded engagement with retainer portion 150*b* and retains biasing component 152 within retainer portion 150*b*. Also, pin 156 passes through biasing component 152 and nut 154 and secures with retainer portion 150*a* by a threaded engagement. Based on the assembled configuration, biasing component 152 is pulled in tension. As a result, biasing component 152 provides a counterforce that causes retainer portions 150*a* and 150*b* to engage each other. extension 160 passes through clip 162 to form a mechanical engagement between extension 160 and clip 162. In this regard, clip 162 provides an additional engagement force between retainer portion 150*a* and 150*b*.

Figure 9:
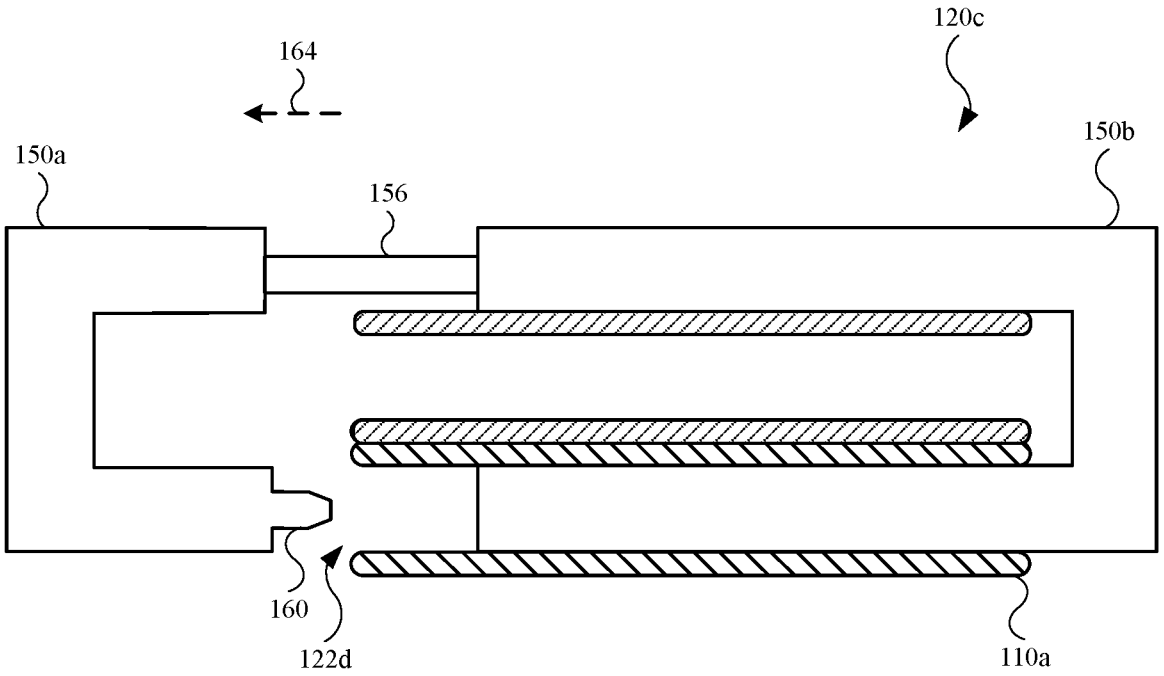
FIG. 9 illustrates a cross-sectional view of a band retainer, showing relative movement of the retainer portions, in accordance with aspects of the present disclosure.

Referring to FIG. 9, a force (in the direction of arrow 164) to retainer portion 150*a* causes retainer portion 150*a* to move relative to retainer portion 150*b*. As result, retainer portions 150*a* and 150*b* separate, or disengage, from each other. While retainer portions 150*a* and 150*b* are separated, pin 156 limits movement of retainer portion 150*a* with respect to retainer portion 150*b*, and maintains a connection between components (e.g., retainer portions 150*a* and 150*b*) of band retainer 120*c*. For example, pin 156 allows relative movement of retainer portion 150*a* such that extension 160 is removed from opening 122*d* of band 110*a*. The force required to separate retainer portions 150*a* and 150*b* in a manner shown in FIG. 9 is greater than a combination of the force provided by biasing component 152 (shown in FIG. 8) and the mechanical force provided by clip 162 (shown in FIG. 8) to extension 160. Alternatively, it should be noted that the force can be provided to retainer portion 150*b* to cause retainer portion 150*b* to move relative to retainer portion 150*a*.

Figure 10:
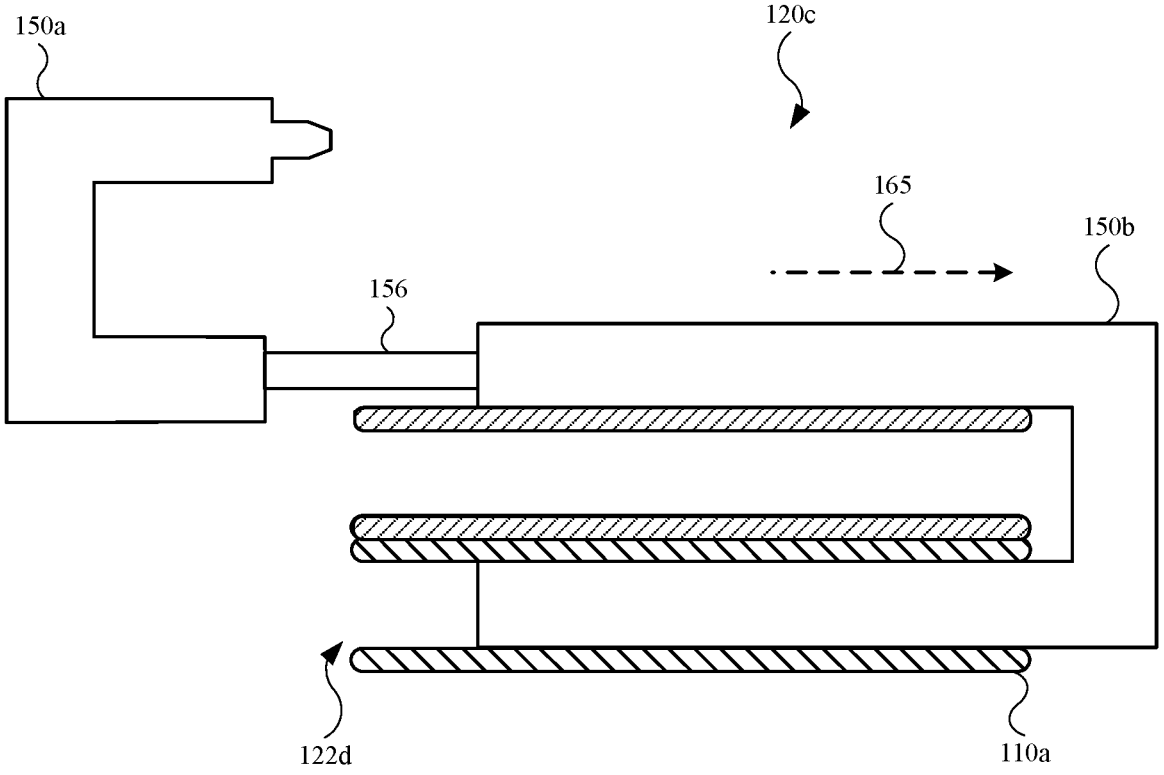
FIG. 10 illustrates a cross-sectional view of a band retainer, showing the band retainer being removed from the band, in accordance with aspects of the present disclosure.

Referring to FIG. 10, while the force used to separate retainer portions 150*a* and 150*b* is still applied, retainer portion 150*a* can be rotated relative to retainer portion 150*b*, allowing band retainer 120*c* to move in a direction of arrow 165. As a result, retainer portion 150*b* is removed from opening 122*d* and band retainer 120*c* is separated from bands 110*a* and 110*b*. While retainer portion 150*a* is rotated approximately 180 degrees, retainer portion 150*a* can be rotated approximately to at least 90 degrees to allow retainer portion 150*b* to be removed from opening 122*d* and band retainer 120*c* to separate from bands 110*a* and 110*b*. When the separation force to retainer portions 150*a* and 150*b* is no longer applied (or at least reduced to a force less than that provided by biasing component 152, show in FIG. 8), retainer portions 150*a* and 150*b* may again engage with each other in a manner similar to FIG. 8.

Figure 11:
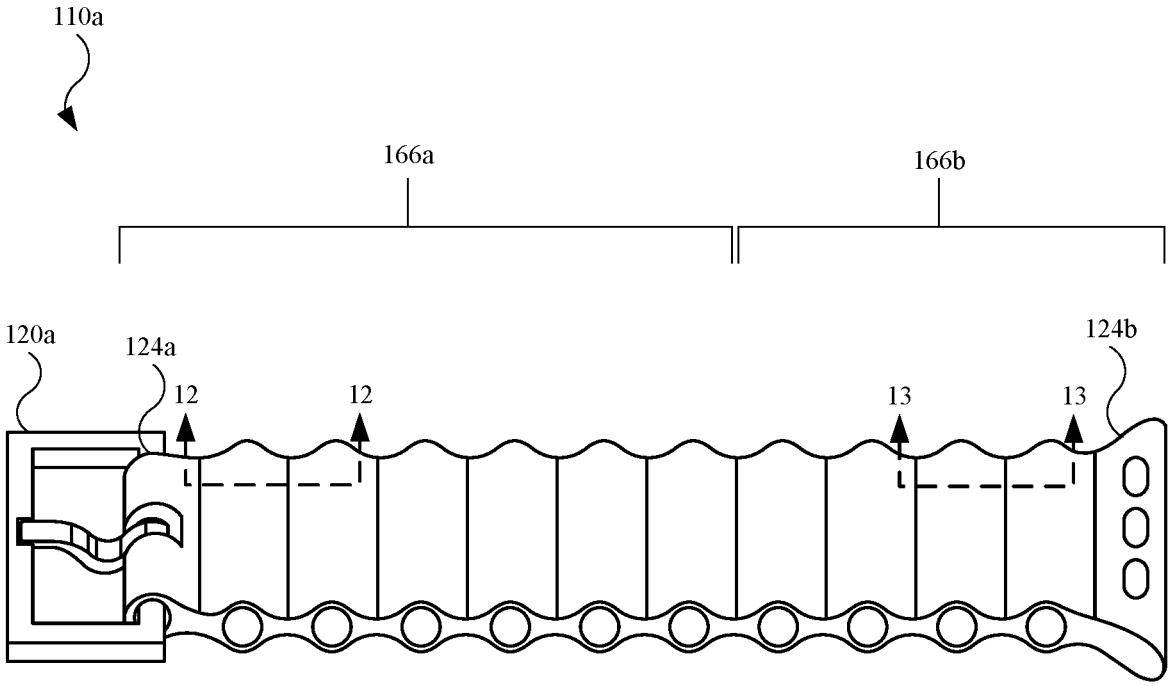
FIG. 11 illustrates a perspective view of a band, showing asymmetric features of the band, in accordance with aspects of the present disclosure.

Referring to FIG. 11, band 110*a* may include a gradated design such that the material thickness of band 110*a* is different in different regions. For example, the material thickness at a 166*a* region proximate to end 124*a* where band retainer 120*a* is located may be greater than the material thickness at a 166*b* region proximate to end 124*b*, where band 110*a* secures with device housing 102 (shown in FIG. 1).

Figure 12:
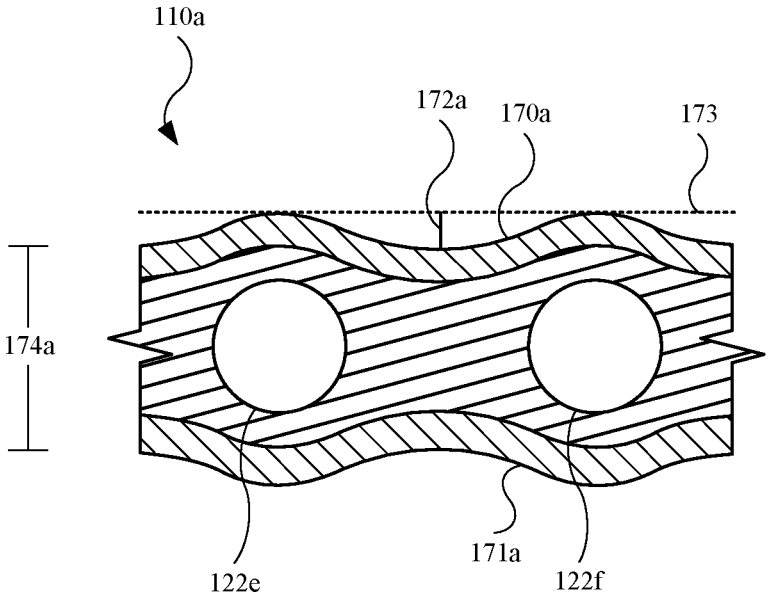
FIG. 12 illustrates a cross-sectional view of a band, taken along line 12-12 in FIG. 11, showing a concave shape of the band, in accordance with aspects of the present disclosure.

Referring to FIG. 12, a region of band 110*a*, taken along line 12-12 in FIG. 11, between adjacent openings includes a concave portion based on the material thickness of band 110*a* at region 166*a* (shown in FIG. 11). For example, a concave portion 170*a* formed between an opening 122*e* and an opening 122*f* (adjacent to opening 122*e*) is defined in part by a crown value 172*a* of band 110*a* and a thickness 174*a* of band 110*a*. As shown in FIG. 12, crown value 172*a* (representative of other crown values shown and described herein) can be defined by a dimension that extends from a line 173 connecting adjacent uppermost portions of band 110*a* (e.g., over openings 122*e* and 122*f*) to a lowermost point of concave portion 170*a*. Thickness 174*a* represents a dimension from concave portion 170*a* to a corresponding concave portion 171*a*.

Figure 13:
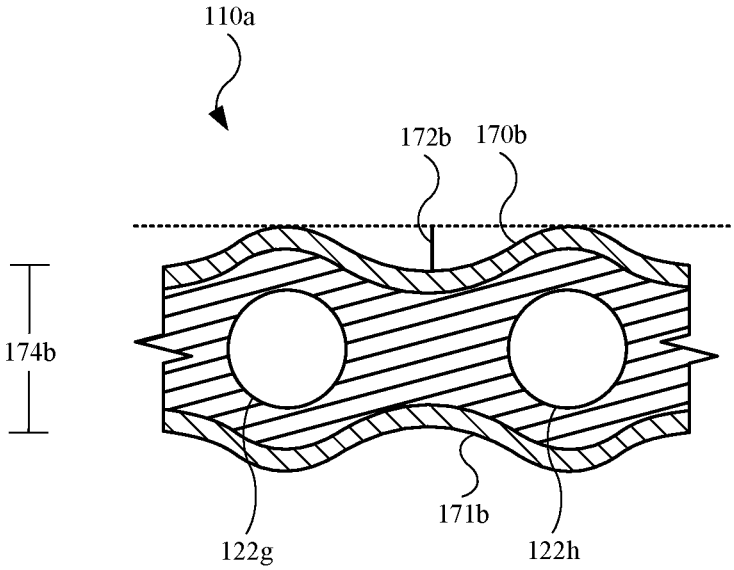
FIG. 13 illustrates a cross-sectional view of a band, taken along line 13-13 in FIG. 11, showing a concave shape of the band, in accordance with aspects of the present disclosure.

Referring to FIG. 13, a region of band 110*a*, taken along line 13-13 in FIG. 11, between adjacent openings includes a concave portion based on the material thickness of band 110*a* at region 166*b* (shown in FIG. 11), with the concave portion being different from that shown in FIG. 12. For example, a concave portion 170*b* formed between an opening 122*g* and an opening 122*h* (adjacent to opening 122*g*) is defined in part by a crown value 172*b* of band 110*a* that is greater than the crown value 172*a* shown in FIG. 12. For example, crown value 172*b* may include a dimension approximately in the range of 0.3 millimeters (mm) to 0.6 mm, while crown value 172*a* (shown in FIG. 12) may include a dimension approximately in the range of 0.15 mm to 0.25 mm. Also, concave portion 170*b* is defined in part by a thickness 174*b* of band 110*a* that includes a dimension that is less than that of thickness 174*a* shown in FIG. 12. Thickness 174*b* represents a dimension from concave portion 170*b* to a corresponding concave portion 171*b*.

The asymmetric design of band 110*a*, provided in part by different material thickness and different concave portions, allows for the flexibility of band 110*a* in different locations. For example, concave portion 170*b* (shown in FIG. 13) represents a region of less thickness, thus allowing band 110*a* to more readily bend or flex, as compared to the region of greater thickness, i.e., concave portion 170*a* (shown in FIG. 12). Beneficially, band 110*a* is designed to wrap around a user's wrist at a region (e.g., region 166*b* in FIG. 11) of lesser thickness, while being more rigid, and thus flatter, at a region (e.g., region 166*a* in FIG. 11) of greater thickness where band 110*a* generally covers a relatively flat portion of the user's wrist. Moreover, the material(s) used to make band 110*a* may undergo less stress and tension at a region where band 110*a* bends/curves, i.e., the region of reduced thickness of band 110*a*. This may obscure or eliminate unwanted curvature of band 110*a* at a location in which the user can view band 110*a* while viewing a wearable device display.

The transition from concave portion 170*a* to concave portion 170*b*, or vice versa, may be dictated in part by the region associated with bending of band 110*a* when worn by a user. Alternatively, the transition from concave portion 170*a* to concave portion 170*b*, or vice versa, may include a gradual transition. Also, it should be noted that band 110*b* (shown in FIG. 3) may include similar gradated features and crown features as those shown and described in FIGS. 11-13 for band 110*a*.

FIGS. 14-19 show and describe additional features for a band or a band retainer, some of which may be incorporated into a band or a band retainer, respectively, previously described herein. Additionally, a band or a band retainer shown and described in FIGS. 14-19 may include at least some features previously shown and described for a band or a band retainer, respectively.

Figure 14:
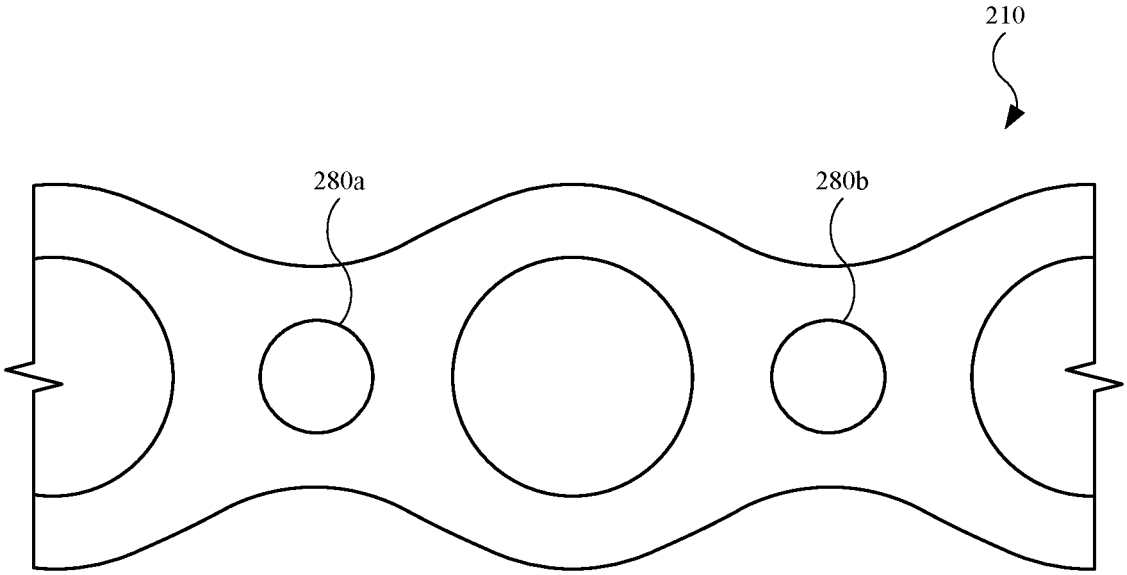
FIG. 14 illustrates a side view of a band, showing inserts embedded in the band, in accordance with aspects of the present disclosure.

Referring to FIG. 14, a band 210 includes an insert 280*a* and an insert 280*b*. Inserts 280*a* and 280*b* are designed to reduce unwanted curvature when band 210 is bent (e.g., when placed around a user's wrist). Inserts 280*a* and 280*b* may be integrated with band 210 through a molding operation, such as insert molding, as a non-limiting example. Inserts 280*a* and 280*b* may include one or more polymer materials.

Figure 15:
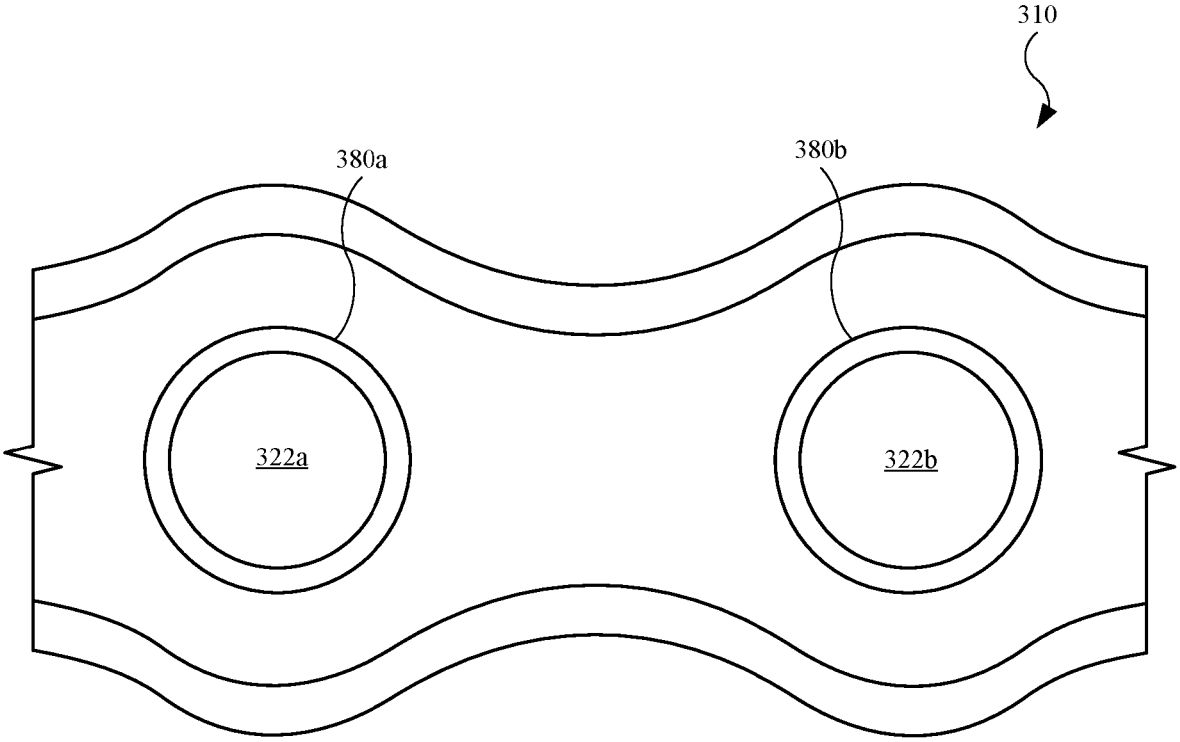
FIG. 15 illustrates a side view of a band, showing inserts embedded in openings of the band, in accordance with aspects of the present disclosure.

Referring to FIG. 15, a band 310 includes an insert 380*a* and an insert 380*b* positioned in an opening 322*a* and an opening 322*b*, respectively, of band 310. Inserts 380*a* and 380*b* are designed to increase the strength of band 310. Inserts 380*a* and 380*b* may include one or more metals, such as stainless steel (as a non-limiting example), that provide an aesthetic finish. Alternatively, inserts 380*a* and 380*b* may include one or more polymer materials.

Figure 16:
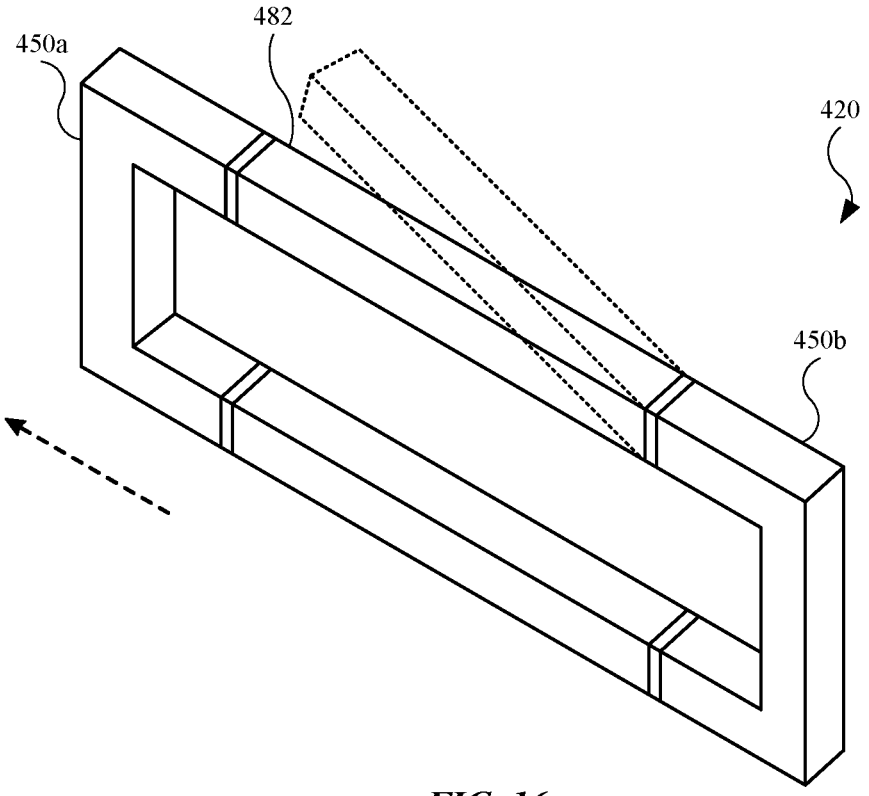
FIG. 16 illustrates a perspective view of a band retainer, showing an additional feature that can be integrated with the band retainer, in accordance with aspects of the present disclosure.

Referring to FIG. 16, a band retainer 420 includes a retainer portion 450*a*, a retainer portion 450*b*, and a bar 482 between retainer portions 450*a* and 450*b*. In order to remove band retainer 420 from a band (not shown in FIG. 16), retainer portion 450*a* is pulled apart from retainer portion 450*b*. When providing a force to retainer portion 450*a*, bar 482 may unlock and simultaneously move relative to retainer portions 450*a* and 450*b*, as indicated by the dotted lines. As an example, bar 482 may move approximately 45 degrees. Bar 482 can be subsequently locked when retainer portions 450*a* and 450*b* subsequently engage each other.

Figure 17:
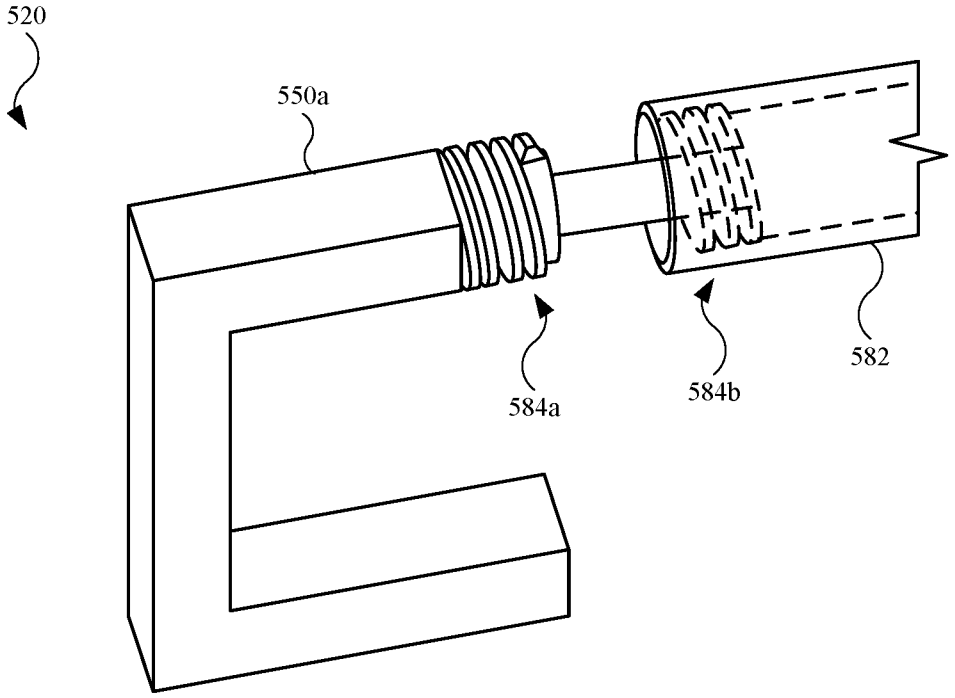
FIG. 17 illustrates a perspective view of a band retainer, showing threaded regions integrated with the band retainer, in accordance with aspects of the present disclosure.

Referring to FIG. 17, a band retainer 520 includes a retainer portion 550*a* and a bar 582 with a threaded region 584*a* and a threaded region 584*b*, respectively. Threaded regions 584*a* and 584*b* are designed to maintain a threaded engagement between retainer portion 550*a* and bar 582. Although not shown in FIG. 17, band retainer 520 may include an additional retainer portion.

Figure 18:
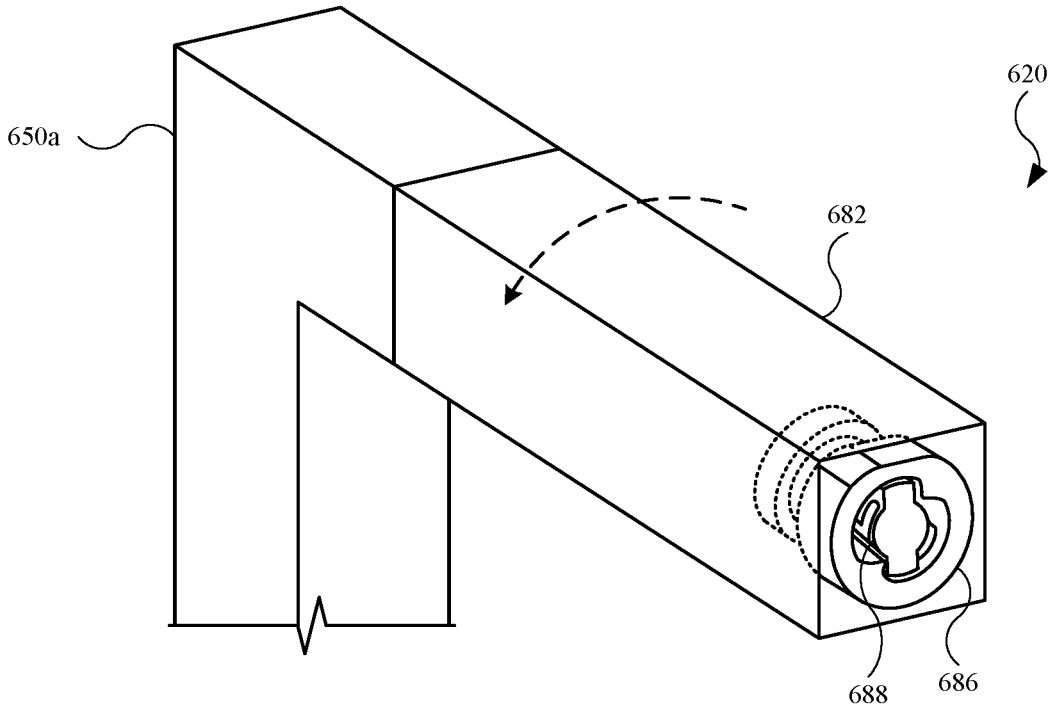
FIG. 18 illustrates a perspective view of a band retainer, showing an additional locking mechanism integrated with the band retainer, in accordance with aspects of the present disclosure.

Referring to FIG. 18, a band retainer 620 includes a retainer portion 650*a* and a bar 682. A fitting 686 and a locking mechanism 688 are located in bar 682. Fitting 686 includes a cam design such that when bar 682 is rotated, fitting 686 rotates with bar 682, thereby allowing locking mechanism 688 to disengage with, or unlock from, an additional retainer portion (not shown in FIG. 18). A force provided by a biasing component (not shown in FIG. 18) may cause locking mechanism 688 to disengage from the additional retainer portion when fitting 686 is rotated to allow movement of locking mechanism 688. Retainer portion 650*a* can subsequently be moved relative to the additional retainer portion.

Figure 19:
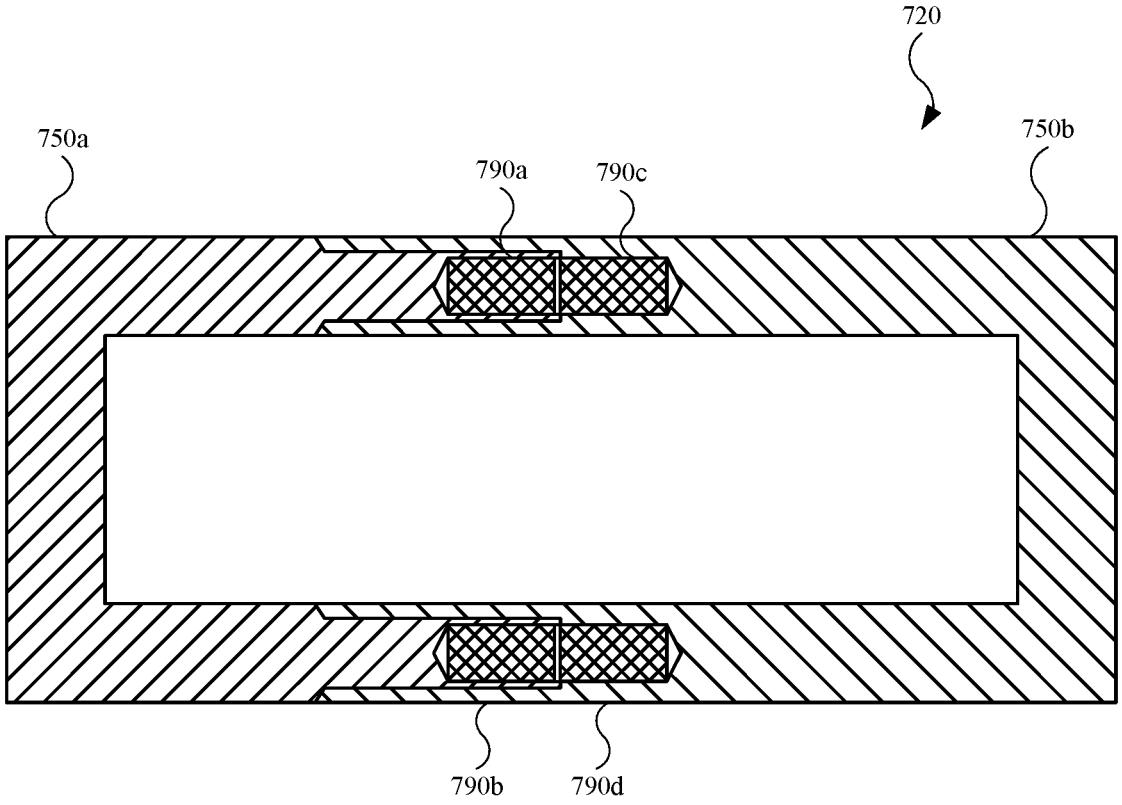
FIG. 19 illustrates a cross-sectional view of a band retainer, showing magnets integrated with the band retainer, in accordance with aspects of the present disclosure.

Referring to FIG. 19, band retainer 720 includes a retainer portion 750*a* and a retainer portion 750*b*. As shown, retainer portion 750*a* includes a magnet 790*a* and a magnet 790*b*, and retainer portion 750*b* includes a magnet 790*c* and a magnet 790*d*. To maintain engagement between retainer portions 750*a* and 750*b*, magnets 790*a* and 790*b* are magnetically coupled to magnets 790*c* and 790*d*, respectively. To separate retainer portions 750*a* and 750*b*, a force is applied to at least one of retainer portions 750*a* and 750*b* that is greater than a combination of the force provided by a magnetic circuit between magnets 790*a* and 790*c* and the force provided by a magnetic circuit between magnets 790*b* and 790*d*. In this regard, retainer portions 750*a* and 750*b* can be separated and fully disconnected from each other. In some embodiments (not shown), a cable is connected to retainer portions 750*a* and 750*b*, allowing separation of retainer portions 750*a* and 750*b*, but providing at least some connection between retainer portions 750*a* and 750*b*.

Various examples of aspects of the disclosure are described below as clauses for convenience. These are provided as examples, and do not limit the subject technology.

Clause A: A band assembly for a wearable device, the band assembly including: a first band including a first opening and a second opening; a second band; and a band retainer configured to secure the second band with the first band, the band retainer including: a first retainer portion, a second retainer portion coupled with the first retainer portion, wherein i) in a first position, the band retainer is securable with the first band at the first opening, and ii) in a second position, the band retainer is securable with the first band at the second opening.

Clause B: A band assembly for a wearable device, the band assembly including: a band including a first opening, a second opening, and a third opening; a first band retainer located in the first opening; a second band retainer affixed to the band at the second opening; and a third band retainer configured to secure with the band at the third opening, wherein the third band retainer is removable from the third opening.

Clause C: A band assembly for a wearable device, the band assembly including: a band including: a first end; a second end opposite the first end; a plurality of openings extending from the first end to the second end, the plurality of openings including: a first opening, a second opening, a third opening, a fourth opening, a first concave portion between the first opening and the second opening, the first concave portion including a first concave shape; and a second concave portion between the first opening and the second opening, the second concave portion including a second concave shape different from the first concave shape.

Clause D: A system including: an electronic device including: a display configured to present visual information, and a device housing that carries the display, the device housing including a first receptacle and a second receptacle; and a band assembly including: a first band secured to the first receptacle, the first band including a first opening and a second opening, a second band secured to the second receptacle, and a removable band retainer securable with the first band at the first opening, wherein the removable band retainer is configured to be removable from the first opening and subsequently secured with the first band at the second opening.

One or more of the above clauses can include one or more of the features described below. It is noted that any of the following clauses may be combined in any combination with each other, and placed into a respective independent clause, e.g., clause A, B, C, or D.

Clause 1: wherein: the band retainer further includes a biasing component, and the first retainer portion engages the second retainer portion based on a force provided by the biasing component.

Clause 2: wherein when an external force provided to one of the first retainer portion and the second retainer portion overcomes the force provided by the biasing component, the first retainer portion is configured to separate from the second retainer portion to allow removal of the band retainer from one of the first opening and the second opening.

Clause 3: further including a pin secured with the first retainer portion, wherein the pin extends through the biasing component.

Clause 4: further including a nut located in the second retainer portion, wherein the nut secures the biasing component within the second retainer portion, and the pin extends through the nut.

Clause 5: wherein: the first retainer portion includes an extension, and the second retainer portion includes a cavity that receives the extension.

Clause 6: wherein the second retainer portion includes a clip located within the cavity, and the clip is configured to secure with the extension.

Clause 7: wherein: the band includes a first end and a second end opposite the first end, and the first opening is located at the first end, and the second end is configured to secure to a device housing of an electronic device.

Clause 8: wherein: the first opening includes a tapered opening, the first band retainer includes a loop and a tang secured with the loop, and the loop and the tang frictionally engage the first opening based on the tapered opening.

Clause 9: wherein: the loop includes a cavity, and the tang includes a retractable pin located in the cavity.

Clause 10: wherein the third band retainer includes: a first retainer portion; a second retainer portion; and a pin secured with the first retainer portion and the second retainer portion.

Clause 11: wherein the first retainer portion is movable with respect to the second retainer portion, and the first retainer portion is limited in movement by the pin.

Clause 12: wherein each of the first band retainer, the second band retainer, and the third band retainer is configured to receive a second band.

Clause 13: wherein: the first concave portion is defined by a first crown value, and the second concave portion is defined by a second crown value greater than the first crown value.

Clause 14: wherein: the first end carries a first band retainer, and the second end is configured to secure within a device housing of an electronic device.

Clause 15: wherein the first concave portion is closer to the first end than the second end.

Clause 16: wherein the second concave portion is closer to the second end than the first end.

Clause 17: wherein the band includes: a first thickness that defines the first concave portion; and a second thickness that defines the second concave portion, wherein the second thickness is less than the first thickness.

Clause 18: wherein the removable band retainer includes: a first retainer portion; a second retainer portion coupled with the first retainer portion; and a biasing component, wherein the first retainer portion engages the second retainer portion based on a force provided by the biasing component.

Clause 19: wherein when an external force provided to one of the first retainer portion and the second retainer portion overcomes the force provided by the biasing component, the first retainer portion is configured to separate from the second retainer portion to allow removal of the removable band retainer from one of the first opening and the second opening.

Clause 20: wherein: the first retainer portion includes an extension, and the second retainer portion includes a cavity that receives the extension.

Clause 21: wherein the second retainer portion includes a clip located within the cavity, and the clip is configured to secure with the extension.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

As used herein, the phrase "one of" preceding a series of items, with the term "and" to separate any of the items, modifies the list as a whole, rather than each member of the list (i.e., each item). The phrase "one of" includes a selection of one item in the list. By way of example, the phrase "one of A, B, and C" refers to only A, only B, or only C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration". Any embodiment described herein as "exemplary" or as an "example" is not necessarily to be construed as preferred or advantageous over other embodiments. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more". Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A band assembly for a wearable device, the band assembly comprising:

a first band comprising a first opening and a second opening;

a second band; and a band retainer configured to secure the second band with the first band, the band retainer comprising:

a first retainer portion comprising an extension, a second retainer portion comprising a cavity configured to receive the extension, a clip located in the cavity and configured to receive the extension, wherein i) in a first position, the band retainer is securable with the first band at the first opening, and ii) in a second position, the band retainer is securable with the first band at the second opening.

2. The band assembly of claim 1, wherein:

the band retainer further comprises a biasing component, and the first retainer portion engages the second retainer portion based on a force provided by the biasing component.

3. The band assembly of claim 2, wherein when an external force provided to one of the first retainer portion and the second retainer portion overcomes the force provided by the biasing component, the first retainer portion is configured to separate from the second retainer portion to allow removal of the band retainer from one of the first opening or the second opening.

4. The band assembly of claim 2, further comprising a pin secured with the first retainer portion, wherein the pin extends through the biasing component.

5. The band assembly of claim 4, further comprising a nut located in the second retainer portion, wherein the nut secures the biasing component within the second retainer portion, and the pin extends through the nut.

6. The band assembly of claim 1, wherein the first opening comprises:

a first diameter; and a second diameter different from the first diameter.

7. The band assembly of claim 6, wherein:

the first diameter is located at a distal region of the first band, the second diameter is located at a proximal region of the first band, and the first diameter is greater than the second diameter.

8. A band assembly for a wearable device, the band assembly comprising:

a band comprising a first opening, a second opening, and a third opening, wherein the first opening comprises a tapered opening;

a first band retainer located in the tapered opening, the first band retainer comprising a loop and a tang secured with the loop, wherein the loop and the tang frictionally engage the tapered opening;

a second band retainer affixed to the band at the second opening; and a third band retainer configured to secure with the band at the third opening, the third band retainer comprising:

a first retainer portion comprising a first cavity;

a second retainer portion comprising a second cavity; and a pin positioned in the first cavity and the second cavity, wherein the third band retainer is configured to be removable from the third opening.

9. The band assembly of claim 8, wherein:

the band comprises a first end and a second end opposite the first end, and the first opening is located at the first end, and the second end is configured to secure to a device housing of an electronic device.

10. The band assembly of claim 8, wherein:

the loop comprises a cavity, and the tang comprises a retractable pin located in the cavity.

11. The band assembly of claim 8, wherein the first retainer portion is movable with respect to the second retainer portion, and the first retainer portion is limited in movement by the pin.

12. The band assembly of claim 8, wherein each of the first band retainer, the second band retainer, and the third band retainer is configured to receive a second band.

13. The band assembly of claim 8, further comprising a biasing mechanism, wherein the pin passes through the biasing mechanism.

14. A system comprising:

an electronic device comprising:

a display configured to present visual information, and a device housing that carries the display, the device housing comprising a first receptacle and a second receptacle; and a band assembly comprising:

a first band secured to the first receptacle, a second band secured to the second receptacle, and a removable band retainer configured to secure with the first band and the second band, the removable band retainer comprising:

a first retainer portion;

a second retainer portion coupled with the first retainer portion; and a biasing component, wherein in response to the biasing component being pulled in tension, the biasing component provides a counterforce to the tension such that the first retainer portion engages the second retainer portion.

15. The system of claim 14, wherein when an external force provided to one of the first retainer portion and the second retainer portion overcomes the counterforce provided by the biasing component, the first retainer portion is configured to separate from the second retainer portion to allow removal of the removable band retainer from one of a first opening and a second opening of the first band.

16. The system of claim 14, wherein:

the first retainer portion comprises an extension, and the second retainer portion comprises a cavity that receives the extension.

17. The system of claim 16, wherein the second retainer portion comprises a clip located within the cavity, and the clip is configured to secure with the extension.

18. The system of claim 14, wherein the first band further comprises:

a third opening, a fourth opening, a first concave portion between a first opening of the first band and a second opening of the first band, the first concave portion comprising a first concave shape; and a second concave portion between the first opening and the second opening, the second concave portion comprising a second concave shape different from the first concave shape.

19. The system of claim 14, further comprising:

a biasing mechanism; and a pin that passes that through the biasing mechanism.

* * * * *